US005135221A

United States Patent [19]

Barlow

[11] Patent Number: 5,135,221

[45] Date of Patent: Aug. 4, 1992

[54] SPRING LAUNCHED POP-UP PIN BOWLING GAME

[75] Inventor: Gordon A. Barlow, Highland Park, Ill.

[73] Assignee: Gordon Barlow Design, Highland Park, Ill.

[21] Appl. No.: 772,462

[22] Filed: Oct. 7, 1991

[51] Int. Cl.[5] ..... A63D 3/00

[52] U.S. Cl. ..... 273/41; 273/127 R; 446/4

[58] Field of Search ..... 273/37, 38, 41, 127 R, 273/127 A, 127 B, 127 C, 10; 446/4, 308, 309, 430

[56] References Cited

U.S. PATENT DOCUMENTS

| | | | |
|---|---|---|---|
| 2,776,137 | 1/1957 | Cohn | 273/41 |
| 3,462,153 | 8/1969 | Giraud et al. | 446/308 |
| 3,703,288 | 11/1972 | Vogel et al. | 273/41 |
| 4,265,449 | 5/1981 | Reiner et al. | 273/41 |
| 4,345,402 | 8/1982 | Hanson et al. | 446/430 |

*Primary Examiner*—Paul E. Shapiro
*Assistant Examiner*—William M. Pierce
*Attorney, Agent, or Firm*—Kinzer, Plyer, Dorn, McEachran & Jambor

[57] ABSTRACT

A tabletop bowling game including a small scale replica of a bowling alley. A platform is mounted above the replica of the bowling alley at one end thereof. Ten upstanding posts are formed on the platform with the posts arranged in seven columns extending lengthwise of the bowling alley to provide a pattern of posts similar to the pattern of pins on a bowling alley. Each post receives and supports a small scale replica of a bowling pin. Each small scale replica of a bowling pin has a spring which is compressed by its post and which biases the bowling pin in a direction upwardly off the post. A releasable hook mechanism is provided for holding each bowling pin replica on its post against the bias of the spring. Targets extend downwardly from the platform and terminate slightly above the bowling alley with each target aligned with a single column of posts. Slides connect the targets and the hooks to release one of the hooks from its bowling pin replica upon movement of the target. One of the slides is arranged so that movement of the target aligned with the middle column of posts will release all of the hooks and bowling pin replicas and movement of the target aligned with a column other than the middle column of posts will release less than all of the hooks and their associated bowling pin replicas. A puck is provided to be slid on the alley replica into contact with one of the targets.

3 Claims, 4 Drawing Sheets

69
79

4
73
67
71
73
77
65
71
19
73
77
71
4

13
25
27
31
19
31
15
39
43
17
29
85
17
45

67
69
73
77
75
79
77
71
19
65

SPRING LAUNCHED POP-UP PIN BOWLING GAME

BACKGROUND AND SUMMARY OF THE INVENTION

This invention is directed to a simulated bowling game can be played on a table top or other similar surface. The game is suitable for play by persons of any age, ranging from children to adults, and the number of players is not limited, except by the traditional concept that each bowling team should not have more than five bowlers.

An object of this invention is a simulated tabletop bowling game in which the conventional bowling pins can be replaced by pins in the shape of fanciful figures each holding a replica of a bowling pin which fanciful figures can be relatively light in weight and molded of plastic since they will not be struck during the game by a bowling bowl.

Another object of this invention is a simulated tabletop bowling ball which uses a roller bearing puck instead of a bowling ball.

Another object of this invention is a simulated tabletop bowling game in which the "pins" are not knocked over by a bowling ball but instead are catapulted into the air when the puck used in place of the bowling ball strikes a target associated with and aligned with a particular "pin".

Another object of this invention is a simulated tabletop bowling game in which the contact of the targets by the puck interact with the pins to duplicate the pattern of knock down of pins in an actual bowling game even though the puck used does not contact the "pins". Other objects of this invention will be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENT

Figures 1, 2, 3, 4:
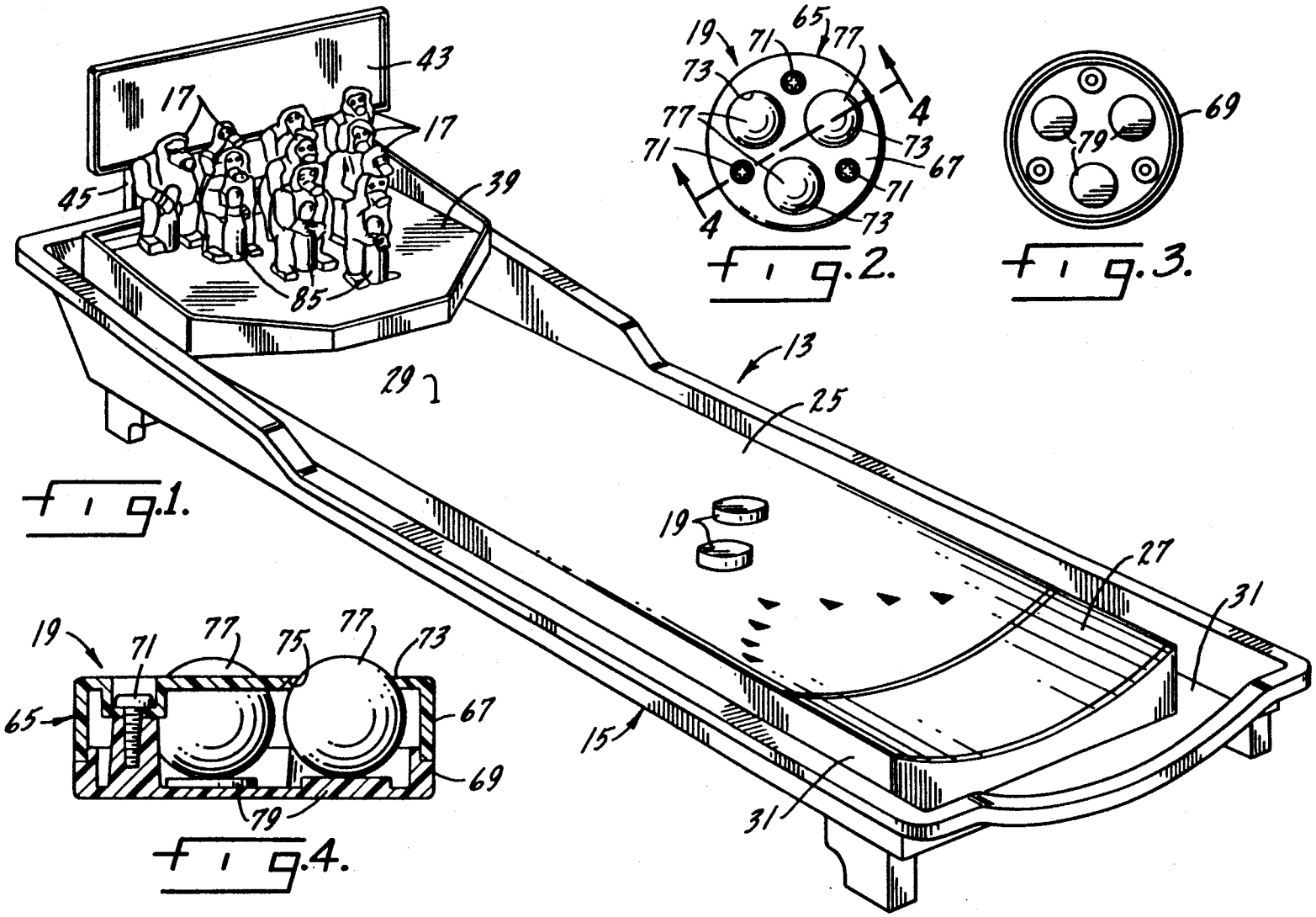
FIG. 1 is a perspective view of the tabletop simulated bowling game of this invention.
FIG. 2 is a bottom plan view of a bowling puck which is used in place of a conventional bowling ball in playing the game of this invention.
FIG. 3 is a bottom plan view of the puck top.
FIG. 4 is an enlarged cross sectional view taken along line 4—4 of FIG. 2.

FIG. 1 of the drawings shows a bowling game and bowling alley replica 13 embodying the novel aspects of this invention. A housing 15 formed of thin walled plastic and in the shape of a table supports the pins 17 which are in the shape of fanciful figurines and also provides a surface for sliding a puck 19 to simulate the action of a bowling ball. The top of the table is a raised alley 25 which has a curved upper surface 27 at the front of the alley and a flat surface 29 at the rear of the alley. Gutters 31 are located on opposite sides of the alley.

Figures 9, 10:
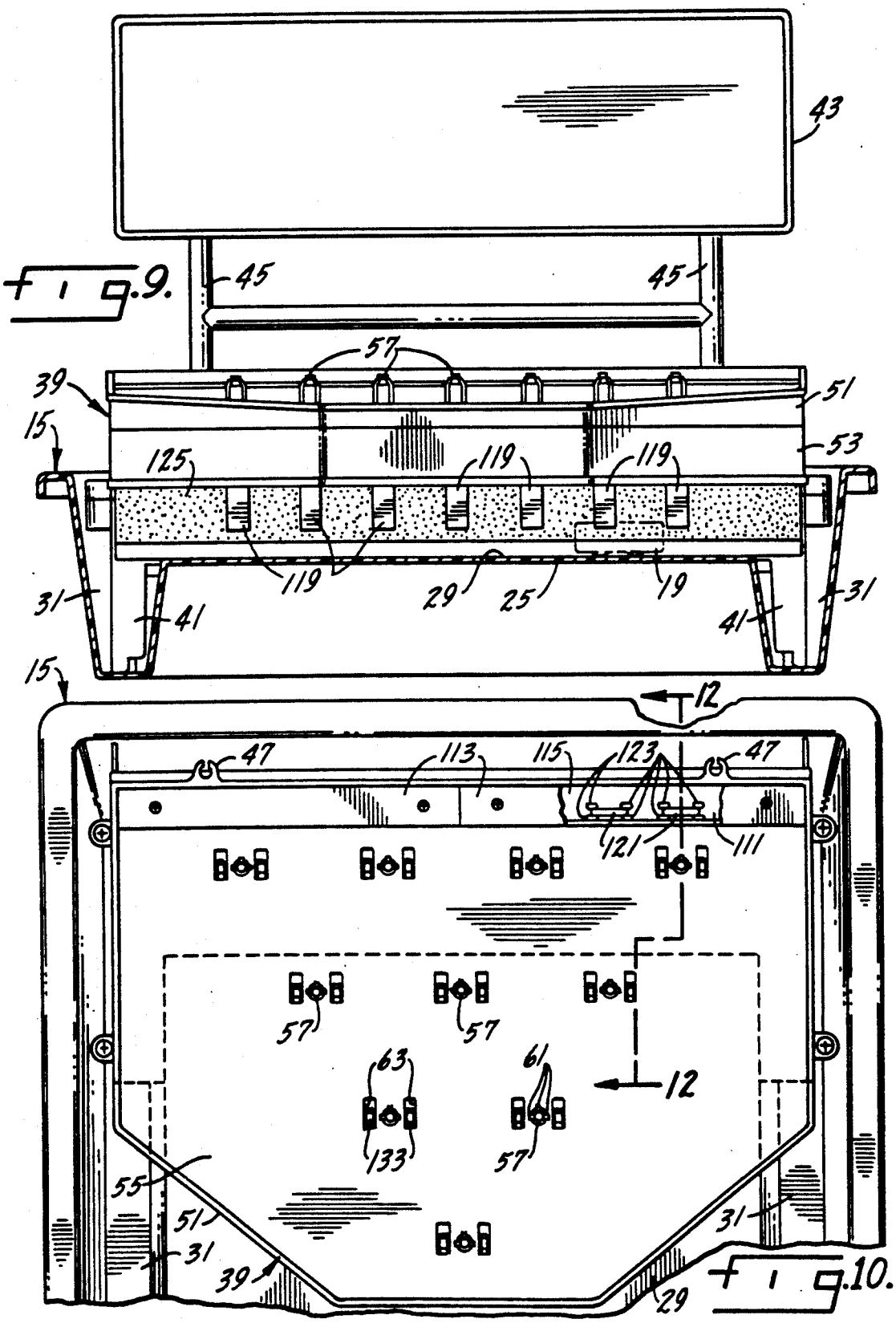
FIG. 9 is a transverse cross sectional view of a portion of the bowling alley of FIG. 1 with the pins removed from their supports.
FIG. 10 is a top plan view of the portion of the bowling alley of FIG. 9 with parts removed.

A hollow platform 39 is supported on the housing 15 at the rear end of the alley and is elevated above the alley 25 a is most clearly shown in FIG. 9. This platform is supported on legs 41 which fit into the gutters 31. A sign 43 is located behind the platform and is supported on posts 45 which in turn fit into sockets 47 formed integrally with the platform 39 as shown in FIG. 10 of the drawings.

The hollow platform 39 as best seen in FIGS. 9–12 consists of a top portion 51 and a bottom portion 53. The top portion 51 has a top wall 55 formed of a thin plastic as can best be seen in FIGS. 10 and 12 of the drawings. Upstanding posts 57 are formed integrally with the top wall 55 and each post is reinforced by a steel pin 59 which extends out of the post and downwardly through the wall 55. Each post is formed with three longitudinally extending ribs 61. Rectangular slots 63 are formed extending through the top wall 55 on opposite sides of each rib.

The puck 19 shown in enlarged detail in FIGS. 2, 3, 4 and 12 of the drawings has a disk shaped housing 65 formed of a lower portion 67 and an upper portion 69. The two housing portions are held together by screws 71. Three openings 73 are formed in the lower portion 67 of the housing with each opening having an inwardly extending beveled edge 75 as shown in FIG. 4 of the drawings. Ball bearings 77 which function as rollers are located in the housing and extend outwardly through the openings 73. Pads 79 are formed integrally with the upper housing portion 69 to position the ball bearings in the openings 73.

Figure 5:
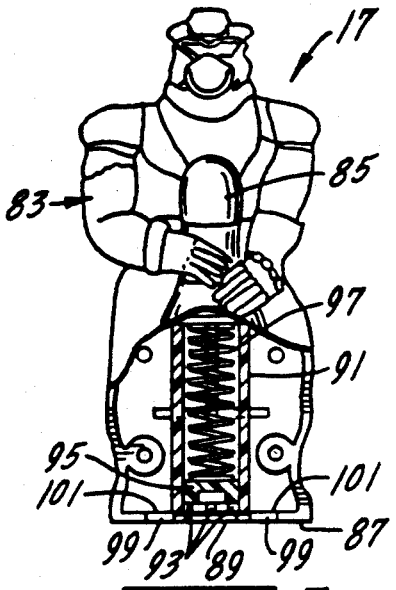
FIG. 5 is a front elevational view of a pin in the shape of a fanciful figure with a portion broken away to show the internal construction features.
Figure 6:
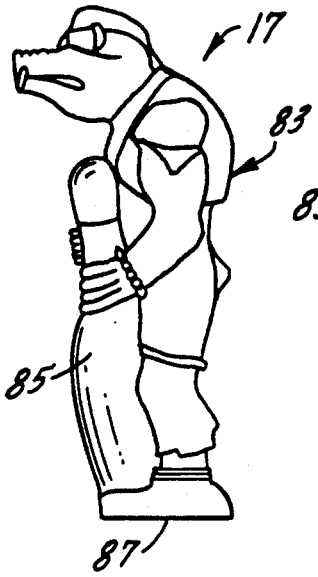
FIG. 6 is a side elevational view of the pin of FIG. 5.
Figure 7:
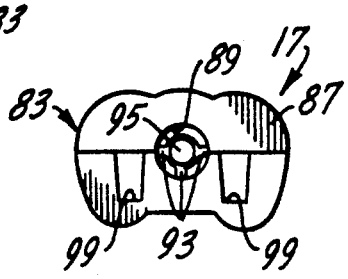
FIG. 7 is a bottom plan view of the pin of FIG. 5.

Each pin replica 17, shown in enlarged detail in FIGS. 5, 6, 7 and 12 of the drawings, consists of a hollow two-part housing 83 which is injection molded of a thin walled plastic. The exterior appearance of the housing 83 can be that of a fanciful character holding a bowling pin 85 as shown in FIGS. 5 and 6 of the drawings. The housing 83 includes a flat base 87 in which is formed a circular opening 89 which leads into a plastic tube 91 positioned in the hollow housing. Radially extending slots 93 are formed in the tube 91. A plunger 95 telescopes in the tube 91 and is biased towards the opening in the hollow housing 83 by a compression spring 97. Rectangular openings 99 are formed in the base 87 of the housing on opposite sides of the circular opening 89. An interior ledge 101 formed by the housing 83 is located adjacent each opening 99.

Figure 12:
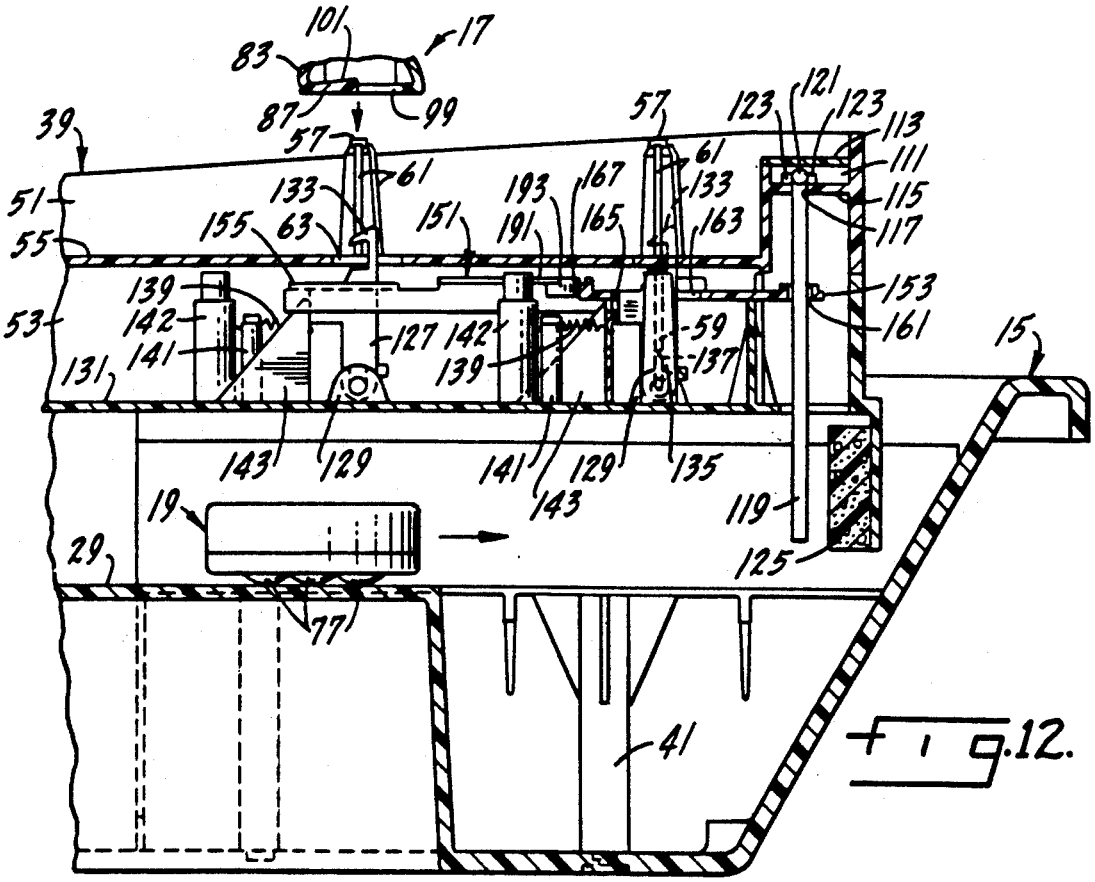
FIG. 12 is an elongated longitudinal cross sectional view of the pin platform with some parts shown in exploded view and others in cross section, taken along line 12—12 of FIG. 10.

Referring specifically now to FIGS. 10 and 12 of the drawings, the top portion 51 of the platform 37 includes an enclosure 111 which extends across the width of the platform at the rear thereof and has removable top walls 113. The enclosure includes a bottom wall 115 having a series of slots 117 formed therein. Elongated rectangular targets 119 extend through the slots 117 to below the platform 39 and terminate just above the flat alley surface 29 of the alley 25 as shown in FIGS. 9 and 12 of the drawings. As can best be seen in FIG. 9 of the drawings, there is one target 119 aligned with each row of posts 57 formed on the platform 39 with the targets extending sufficiently close to the alley 25 that they can be contacted by a puck 19 rolled down the alley. As best can be seen in FIGS. 10 and 12 of the drawings, each target 119 is formed with an integral rod 121 at its upper end thereof which functions as an axle to permit the target to swing back and forth. The axle is held in position by nibs 123 formed integrally with the floor 115 of the enclosure 111. Each target 119 is supported so that it can swing rearwardly about its rod 121 as it is struck by the puck 19. A foam plastic back stop 125 limits rearward movement of the targets 119 to cushion the impact of the puck 19.

Figure 11:
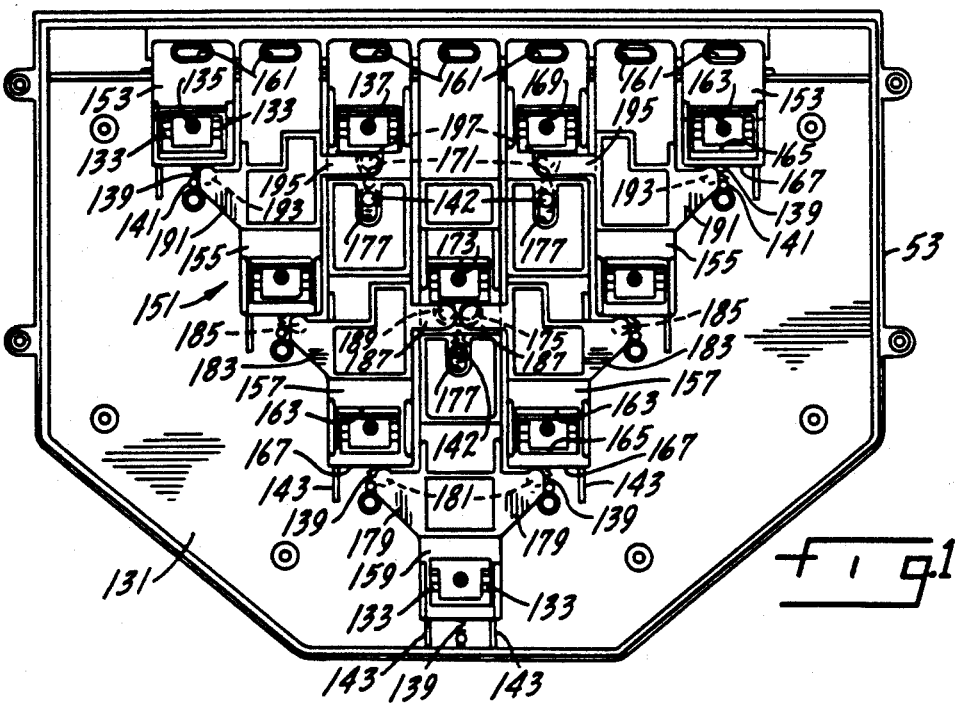
FIG. 11 is a top plan view of the pin support mechanism with the top cover removed.

As can be best seen in FIGS. 10, 11 and 12 of the drawings, a hook mechanism 127 is provided for each post 57 to hold a pin replica 17 in position on the post. The hook mechanisms are pivotally mounted to loops 129 formed integrally with the floor 131 of the platform 39. Each hook mechanism has two teeth 133 which extend through the rectangular slots 63 in the top wall 55 of the platform 39. The teeth 133 are located on opposite sides of posts 135 which extend upwardly from the floor 131 of the platform 39. The posts 135 have openings 137 which receive the steel pins 59 of the upper posts 57. The teeth of the hook mechanisms 127 are biased to forward positions by springs 139 which attach to upstanding posts 141 on the floor 131. Upstanding stops 143 formed integrally with the floor 131 of the platform 39 engage the hook mechanisms to limit forward movement of them under the influence of the springs 139.

A plurality of plastic slides 151 interconnect the targets 119 and the hook mechanisms 127. There are three types of slides 151 as can be best seen in FIG. 11 of the drawings. There are two short outer slides 153, one located on each side of the platform 39. There are two second column slides 155, each located inwardly of the slides 153. There are two third column slides 157 and a middle column slide 159 located inwardly of the second column slides. The slides form a triangular shaped pattern as viewed in FIG. 11.

Each slide has a slot 161 at one end thereof which receives a target 119 and each slide has at least one rectangular opening for receiving and engaging a hook mechanism 127. In slides such as slides 153 and 155 which have only one rectangular opening and in slides 157 and 159 which have two rectangular openings, the openings at the front end are identical. These openings are identified by the numeral 163 and have an inner edge 165 which engages the hook structure 127 and a forward edge 167. Slides 157 each have additional rear rectangular opening 169 with a circular cutout 171 at the forward end thereof. Middle column slide 159 has an additional rectangular opening 173 formed therein and this rectangular opening has an elongated cutout 175 at the forward end thereof. Slides 157 and 159 also have elongated slots 177 which receive the slide posts 142.

The triangular arrangement of slides 151 provides a pyramiding effect to the other slides 151 when the target 119 for the middle slide 159 is struck by the puck 19 because the slide 159 is formed with laterally extending arms 179 each having downwardly projecting tabs 181 formed thereon which tabs engage the forward edges 167 of the rectangular openings 163 in the adjacent slides 157. Each slide 157 is formed with a laterally extending arm 183 with one slide having an arm 183 extending to the right and the other slide having an arm 183 extending to the left as viewed in FIG. 11. A downwardly extending tab 185 is formed on the end of each arm 183 with the tab engaging the forward edge 167 of the adjacent slides 155. Each slide 157 also has an oppositely extending arm 187 having a tab 189 which fits in the elongated cutout 175 of the middle slide 159 to engage the rearward hook mechanism 127. Thus, each slide 157 is interlocked with the slides on each side thereof. Each slide 155 has a laterally outwardly extending arm 191 with a tab 193 which engages the forward edge 167 around the rectangular opening 163 in a slide 153. Each slide 155 also has a lateral arm 195 which extends inwardly and has a tab 197 which engages a hook mechanism 127 aligned with a slide 157.

The foregoing arrangement of arms and tabs provides a pyramiding arrangement which releases all hook means 127 from engagement with the ledges 101 of their pin FIGS. 17 if a target 119 aligned with the middle column slide 159 is struck by the puck 19. If a target 119 aligned with one or the other of the slides 157 is struck, only five hook mechanisms 127 are released. If a target 119 aligned with a slide 155 is struck by the puck 19 only three hook mechanisms 127 are released and if a target 119 aligned with one of the outer slides 153 is struck by the puck, only one hook mechanism 127 is released. Consequently, it can be seen that the bowling game of this invention operates in a manner similar to an actual bowling game where the number of pins knocked over by a bowling ball or puck depends upon the accuracy of the hit on the pins.

Figure 8:
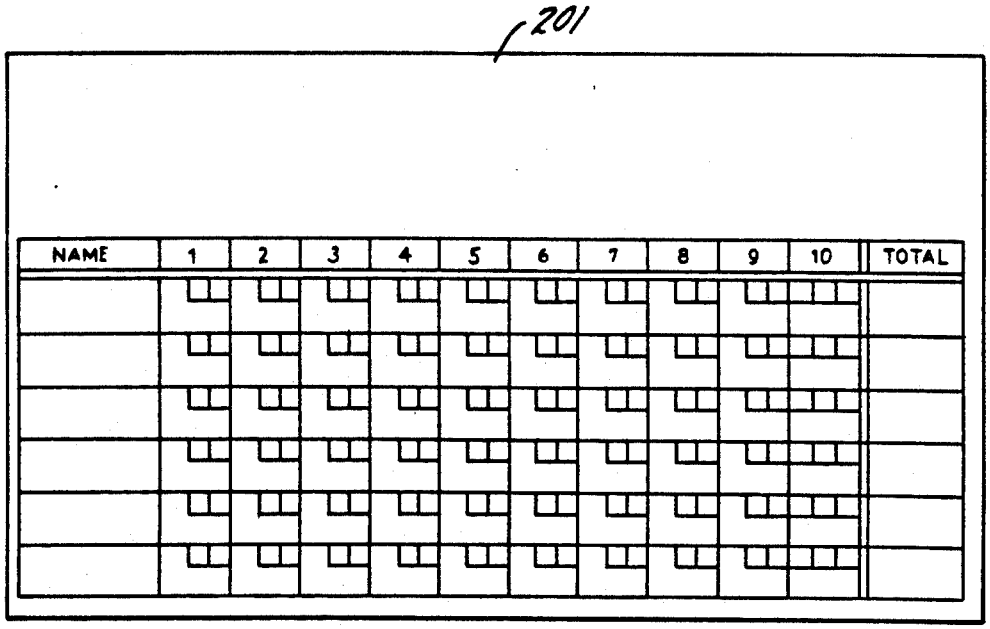
FIG. 8 is a top plan view of a scoring card used with the game.

FIG. 8 of the drawing shows a scorecard 201 which simulates the appearance of a bowling scorecard to enable the players to score the game of this invention in the same manner as a scoring of an actual bowling game.

The embodiments of the invention in which an exclusive property or privilege is claimed are defined as follows:

1. A tabletop bowling game including:

means for defining a small scale replica of a bowling a platform mounted above said means for defining a small scale replica of an elongated bowling alley having two ends, at one end thereof, ten upstanding posts formed on said platform with said posts arranged in seven columns extending along the length of the replica of the alley to provide a pattern of posts similar to the pattern of bowling pins on a full size bowling alley, each post of said pattern of posts adapted to receive and support a small scale replica of a bowling pin of the type found on a full size bowling alley, a small scale replica of a bowling pin adapted to fit over each post of said pattern of posts with each bowling pin replica having a spring means which is compressed by the post on which it fits and which biases the bowling pin off the post, releasable hook means located adjacent said posts of said pattern of posts for holding said bowling pin replicas on said posts against the bias of said spring means, targets extending downwardly from said platform and terminating slightly above said bowling alley with each target aligned with a single column of posts, means connecting said targets and said releasable hook means to release at least one of said hook means from its bowling pin replica upon movement of its associated target with said connecting means arranged so that movement of a target aligned with the middle column of the posts of said pattern of posts will release all of said hook means and bowling pin replicas and movement of a target aligned with a column other than said middle column of posts will release less than all of said hook means and their associated bowling pin replicas; and a puck adapted to be slid on said alley replica into contact with one of said targets.

2. The toy of claim 1 in which said means connecting said targets and said releasable hook means is arranged so that the number of hook means released by movement of a target decreases progressively from the target aligned with the middle column of posts to the target aligned with the outer column of posts.

3. The toy of claim 1 in which said means connecting said target and said releasable hook means includes a plurality of slides with the number of slides equal to the number of targets and in which a slide is aligned with each target, including the outermost targets, a slot formed in each slide to receive a target, at least one hook means receiving cutout formed in each slide with each of said cutouts having an integral edge which engages a hook means, laterally extending arms formed on each of said slides, except the slides aligned with the outermost targets, said arms on each slide engaging either an adjacent slide or the hook means associated with an adjacent slide.

* * * * *